United States Patent [19]

Elsässer et al.

[11] 4,203,085

[45] May 13, 1980

[54] INDUCTION COIL CORE

[75] Inventors: Walter Elsässer, Burgberg; Werner Hofmann, Sonthofen, both of Fed. Rep. of Germany

[73] Assignee: Robert Bosch GmbH, Stuttgart, Fed. Rep. of Germany

[21] Appl. No.: 948,429

[22] Filed: Oct. 4, 1978

[30] Foreign Application Priority Data

Oct. 13, 1977 [DE] Fed. Rep. of Germany ..... 2745990

[51] Int. Cl.[2] ..... H01F 27/24

[52] U.S. Cl. ..... 336/210; 206/443; 336/234

[58] Field of Search ..... 174/119 R, 119 C; 335/297; 310/216; 206/231, 443; 29/155 R, 155 C; 52/230, 724, 725, 730, 723, 659; 105/367; 267/154; 336/210, 219, 233, 234

[56] References Cited

U.S. PATENT DOCUMENTS

| | | | |
|---|---|---|---|
| 1,474,152 | 11/1979 | Kent | 336/234 X |
| 2,107,973 | 2/1938 | Bajon | 336/234 X |
| 2,962,679 | 11/1960 | Stratton | 336/234 X |

*Primary Examiner*—Thomas J. Kozma

*Attorney, Agent, or Firm*—Frishauf, Holtz, Goodman & Woodward

[57] ABSTRACT

Each of the plurality of metal strips combined to form a core unit has a width b substantially less than the radius r of the cross section of the core formed by the strips. The direction of the edges of the strips in the cross section is random.

9 Claims, 1 Drawing Figure

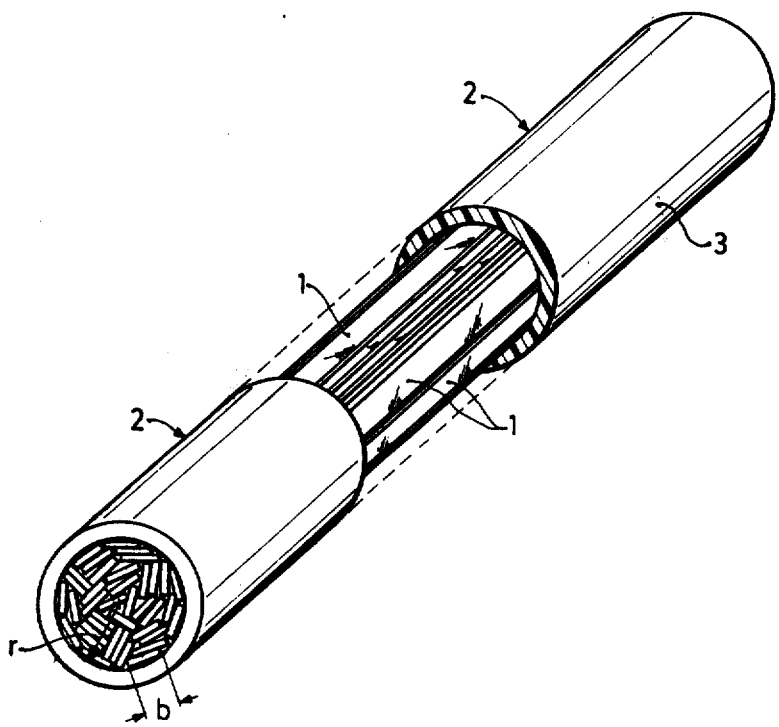
2
3
1
1
2
r
b

INDUCTION COIL CORE

The present invention relates to cores for induction coils and, particularly, to cores for induction coils in ignition systems of internal combustion engines.

BACKGROUND AND PRIOR ART

U.S. Pat. No. 3,497,949 salt, describes a core which includes a plurality of metal strips clustered to form the core. However the strips must be deformed during the manufacturing process. This greatly increases the expense of the cores.

THE INVENTION

It is an object of the present invention to furnish a core which is constructed from a plurality of metal strips but which has the advantage that no deformation of the strips is required. Further, the core in accordance with the present invention is not to be subject to excessive eddy currents. In accordance with the present invention, the plurality of metal strips are clustered to form a core unit having a cross section with a substantially circular circumference with a radium of a first predetermined length. The edges of the metal strips extending in the cross section have a edge length substantially less than said predetermined length and are arranged in random directions in said cross section. Combining means are provided to hold the plurality of metal strips together permanently as a unit.

DRAWING ILLUSTRATING A PREFERRED EMBODIMENT

The single FIGURE is a perspective view of the core according to present invention.

The iron core shown in the FIGURE is to constitute the core for an electric coil and, in particular, for the induction coil in the ignition system of an internal combustion engine. The core comprises a plurality of soft iron metal strips 1 which are clustered together and, in the clustered condition, together form a unit having a cross section with an at least substantially circular circumference having a radius r. The length of the edges of the metal strips extending in the cross section, that is the width of the strips, b, is substantially less than the length of the radius r. Preferably, the radius r is about two to three times as large as the width b of the individual strips 1. In constructing the core, the strips are combined to form a solid unit in which the above-mentioned edges are arranged in random directions in the cross section. The combining means 2 which hold the metal strips together are, in a preferred embodiment, manufactured by dipping the metal strips into a plastic which is then allowed to harden. Such a plastic may for example be a casting resin. In another preferred embodiment the combining means are a sheath and, more particularly, may be a tube having a cross-linked molecular structure or a ribbon or tape with such a molecular structure which is wound around the strips. Such a sheath is shrunk by application of heat, thereby creating a sufficiently strong bond holding the metal strips together. Preferred tubing material is polyvinylide fluoride. The sheath may be either a single unit or comprise a plurality of parts and may also be manufactured from other material than plastic. For example rubber would be suitable.

The following data applies to a preferred embodiment:

Core radius r=15 mm

Width b=6 mm

Plastic utilized to maintain the strips as a unit was Epoxyresin (Hardener: Anhydrite)

Heating took place to a temperature of 100° C.

Various changes and modifications may be made within the scope of the inventive concept.

We claim:

1. Induction coil core comprising a plurality of elongated essentially flat metal strips (1) of magnetic material clustered to form a unit having a cross section with a substantially circular circumference having a radius of a first predetermined length (r) extending from an axis;
   - wherein each of said metal strips has an end edge extending in said cross section and having an end edge length substantially less than said predetermined length;
   - wherein said end edges of said plurality of metal strips are arranged in random directions in said cross section of said unit;
   - each of said metal strips having a pair of elongated edges essentially perpendicular to said end edges and essentially parallel to said axis;
   - and further comprising combining means (2) for permanently maintaining said plurality of metal strips in the shape of said unit.

2. A core as set forth in claim 1, wherein said first predetermined length is approximately equal to two times said end edge length.

3. A core as set forth in claim 1, wherein said radius is approximately three times said end edge length.

4. A core as set forth in claim 1, wherein said combining means comprises a sheath.

5. A core as set forth in claim 4, wherein said sheath is a tube having a cross-linked molecular structure.

6. A core as set forth in claim 5, wherein said tube is a tube made of polyvinylide fluoride.

7. A core as set forth in claim 4, wherein said sheath is a ribbon wound around said plurality of metal strips.

8. A core as set forth in claim 1, wherein said combining means comprises a plastic applied to said metal strips in liquid form and subsequently hardened.

9. A core as set forth in claim 8, wherein said plastic is a casting resin.

* * * * *